US006665636B1

(12) United States Patent
Allouche et al.

(10) Patent No.: US 6,665,636 B1
(45) Date of Patent: Dec. 16, 2003

(54) SIMULATING THE CONTROL OF SOLIDS IN DRILLING FLUIDS, AND APPLICATION TO DETERMINING THE SIZE OF CUTTINGS

(75) Inventors: Mickaël Allouche, Paris (FR); Gérard Daccord, Vauhallan (FR); Eric Touboul, Saint-Etienne (FR)

(73) Assignee: M I LLC., Houston, TX (US)

( * ) Notice: Subject to any disclaimer, the term of this patent is extended or adjusted under 35 U.S.C. 154(b) by 0 days.

(21) Appl. No.: 09/463,078

(22) PCT Filed: Jul. 7, 1998

(86) PCT No.: PCT/EP98/04203

§ 371 (c)(1),
(2), (4) Date: Mar. 20, 2000

(87) PCT Pub. No.: WO99/04133

PCT Pub. Date: Jan. 28, 1999

(30) Foreign Application Priority Data

Jul. 17, 1997 (FR) ..... 97 09082

(51) Int. Cl.[7] ..... G06G 7/48

(52) U.S. Cl. ..... 703/10; 703/9; 703/2; 708/3; 175/206; 175/40

(58) Field of Search ..... 703/9, 10; 175/206, 175/40; 708/3; 702/4

(56) References Cited

U.S. PATENT DOCUMENTS 3,971,926 A * 7/1976 Gau et al. ..... 708/3
4,047,004 A * 9/1977 Peiser ..... 703/9
4,413,511 A * 11/1983 Godbey ..... 73/152.42
4,696,353 A * 9/1987 Elmquist et al. ..... 175/206
4,794,534 A * 12/1988 Millheim ..... 702/9
4,809,791 A * 3/1989 Hayatdavoudi ..... 175/40
5,339,899 A * 8/1994 Ravi et al. ..... 166/250.14
5,695,010 A * 12/1997 Hongo ..... 166/301
5,807,810 A * 9/1998 Blezard et al. ..... 507/103
6,062,313 A * 5/2000 Moore ..... 166/357

OTHER PUBLICATIONS

"The use of a Drilling Simulator to Optimize a Well Drilling Plan" A. Abouzeid, UCLA Berkeley, Dept. of Civil of Environmenta Engineering, 1999.*

"Underbalanced Drilling Model Simulates Dynamic Well Bore Conditions" Z. Wang, Oil & Gas Journal, Jul. 7, 1997.*

* cited by examiner

*Primary Examiner*—Hugh Jones
*Assistant Examiner*—Fred Ferris
(74) *Attorney, Agent, or Firm*—Howrey Simon Arnold & White LLP

(57) ABSTRACT

The present invention relates to a method of modelling a circuit travelled by a drilling mud during drilling, the circuit including both the well and the surface equipment, in particular solid separation devices, in which method, for each time sequence, there are calculated the mass concentration of each liquid and solid species present in the mud, the total flow rate, and the grain size distribution of each solid species downstream from each item of equipment. The invention also provides inversion of the above method to estimate the size of the cuttings on the basis of the measured efficiency of solid separation devices.

20 Claims, 4 Drawing Sheets

SIMULATING THE CONTROL OF SOLIDS IN DRILLING FLUIDS, AND APPLICATION TO DETERMINING THE SIZE OF CUTTINGS

BACKGROUND OF THE INVENTION

The present invention relates to the field of petroleum service and supply industries, and in particular to methods of controlling drilling fluids.

When drilling a well such as an oil well, a drilling fluid or mud is injected mainly for the purposes of conveying cuttings from the bottom to the surface, of cooling and lubricating the drill bit, of maintaining hole size by preventing wall narrowing or caving phenomena, and of preventing in-flow of water, oil, or gas, with the hydrostatic pressure of the drilling mud counterbalancing the pressure exerted by the fluids or gases in the formations.

Drilling mud comprises a liquid phase (water, brine, oil, water-in-oil or oil-in-water emulsion) together with solids in suspension. A wide range of materials are used, but very generally a drilling mud contains a Bentonite type clay which increase the viscosity of the mud and thus gives it good suspensive capacity to oppose any settling of the cuttings, and a weighting material, generally barium sulfate known as barite.

The drilling mud is continuously recycled by solid-separation equipment which removes the cuttings and recovers the more expensive solids, in particular the weighting materials. By way of example, the solid-separation equipment may comprise vibrators, hydrocyclones, settling basins, and centrifuges. The mud also flows through a buffer tank ("active pit") and, of course, through the well.

Properly speaking, the mud does not flow round a "closed" circuit since "fresh" mud needs to be added as the hole becomes longer. Also, a portion of the liquid phase is entrained with the separated-out solids or is "lost" into the well, e.g. where the well passes through formations that are very permeable. All of these losses need to be compensated by fresh mud.

In addition, the separating power of the solid control equipment is never completely effective; in other words none of the devices is capable of eliminating 100% of particles having a diameter greater than a reference diameter and 0% of particles of diameter smaller than the reference diameter. Finally, it should be observed that the flow rate of the mud in circulation may be greater than the processing capacity of the equipment.

For these various reasons, a large portion of the solids is not properly separated out. Since, on each new cycle, the larger cuttings are ground up by the drilling tool, the mud becomes richer over time in fine particles. Unfortunately, above a certain quantity of fines, it becomes necessary to reduce the speed of penetration into the formation, thereby correspondingly delaying the development of the well. Consequently, a mud that is too "old" must be dumped and replaced. This constitutes a significant financial loss for the well-borer.

To minimize inputs, and in particular to avoid dumping as much as possible, it is necessary to improve the overall effectiveness of solid-separation equipment, e.g. by increasing the number of vibrators or centrifuges, or by changing the circuit taken by the 20 mud, in particular by causing it to pass several times through a given device, or indeed by altering the disposition of the various devices (connecting them in series or in parallel).

The problem thus lies in finding a good compromise between the cost of tying up solid-separation equipment (and the cost of taking it to the drilling site), the cost of "fresh" mud, and the cost of dumping, particularly when the mud contains environmentally-harmful additives which make it necessary to perform decontamination treatment.

As a result, the industry has for several years been aware of the need for simulation tools enabling it, in particular, to predict such costs and optimize the mud circulation plan and the choice of solid-separation devices.

Initially, models were developed based on a global approach that took into consideration an initial state (an initial volume of mud having a known composition; said volume corresponding to the volume of mud present in the pit and, where appropriate, the volume in the hole as drilled so far), and the final state corresponding to a mud having a solid matter content complying with precise specifications of the well borer (density and fines content, in particular) and having a volume corresponding to that of the well once it has been drilled. In that global approach, the solid-separation system is represented merely by two coefficients: the liquid/solid ratio Y in the "solid" effluent and the separation efficiency E defined as the ratio of the quantity of cuttings recovered by the various solid-separation devices over the quantity of cuttings actually generated during drilling (which amounts to the inside volume of the well).

Also, as shown in accompanying FIG. 1, by assuming that the mud that is dumped has the same composition as the initial mud, that the solid-separation devices do not separate the Bentonite from the barite, and that the various phases do not interact with one another, it is possible to estimate the volumes and thus the relative costs of the mud to be added and the mud to be dumped merely by writing the various equations for conservation of mass that can be derived directly from the model.

The first advantage of the global approach is its great simplicity. Unfortunately, that simplicity is acquired by treating the mud circuit as a system under steady conditions, and that is very far from being the case. In particular, this approach takes no account of the fact that the mud circulates around a loop and that global separation efficiency depends in particular on the grain size distribution of the solid particles, which distribution varies, as mentioned above, as the mud ages, and also depends on numerous parameters such as, for example, the speed of penetration into the formation by the drill bit, the type of drilling head, the nature of the geological formations being drilled, etc.

Also, by definition, the global approach cannot model different dispositions since it assumes that the global separation efficiency of the system is known, and that is true only insofar as all of the devices are already in operation. Furthermore, the global approach cannot be used to control proper performance of the process on the basis of measurements performed on the surface, such as the density or the volume of mud in the pit.

SUMMARY OF THE INVENTION

The object of the present invention is to provide a new model for the circulation of drilling mud based on commonly accepted physical models including digital processing by time sequences as a function of parameters that may vary from one sequence to another. According to the invention, the grain size distribution of the various solids is calculated for each time sequence starting from an initial state and from the characteristics of each of the solid-separation units.

The mud circuit is modelled by a network of logic units, each of which performs an elementary action: dividing or adding flows, separating-out solids, grinding solids, and adding a flow to a volume that is being drained. Solid separation is performed in application of a partition function. The logic units are associated to model the various solid separation devices, the pit, and the well.

The elementary units process mud objects defined as being associations of n solids and p liquids, each component being characterized by its volume fraction, its density, and for the solid components, a particle size distribution. For each solid, the particle size distribution is modelled by a normalized frequency function F of the type:

$$M_{a,b} = \int_a^b F(x)\,dx \qquad \text{Equation 1}$$

where $M_{a,b}$ is the mass percentage of particles of diameter lying in the range a to b. The value of F is defined by a logarithmic curve defined by the median particle size value $d_{50}$ (50% of the particles are smaller than $d_{50}$) and a standard deviation coefficient $\sigma$ ($\sigma = d_{50}/d_{16}$). The frequency distribution of a particle of size x is thus equal to:

$$f(x) = \frac{1}{x\sqrt{2\pi \ln\sigma}} \exp\left(-\frac{(\ln x - \ln d_{50})^2}{2\ln^2\sigma}\right) \qquad \text{Equation 2}$$

The partition function G of the elementary separation units is defined in the same manner as being the primitive of a normal distribution, $G_i(x)dx$ being the mass percentage in the "solid" effluent of particles of species i of size lying in the range x to x+dx. As for the frequency function F, the partition function G is characterized by a median value $d_{50}$ (50% by mass of the particles of size greater than $d_{50}$ are separated) and by a standard deviation coefficient.

A particularly advantageous aspect of the model of the invention is that it makes it possible, at a given moment, to calculate the efficiency of separation in any solid-separation device that is included in the mud circuit. Conversely, starting from measurements made on site of the efficiency of at least two separation devices, it is possible to invert the model and estimate the initial grain size distribution of the cuttings. It should be observed that the accuracy of this estimate is improved if two devices of different types are selected. This point is particularly advantageous since the grain size distribution of the cuttings is generally not known on a given site since it can be measured only by means of relatively sophisticated measurement devices that are more laboratory equipment than drilling platform equipment.

Other advantageous characteristics and details of the invention appear from the following description given with reference to the accompanying drawings, in which:

DESCRIPTION OF THE PREFERRED EMBODIMENTS

Figure 1:
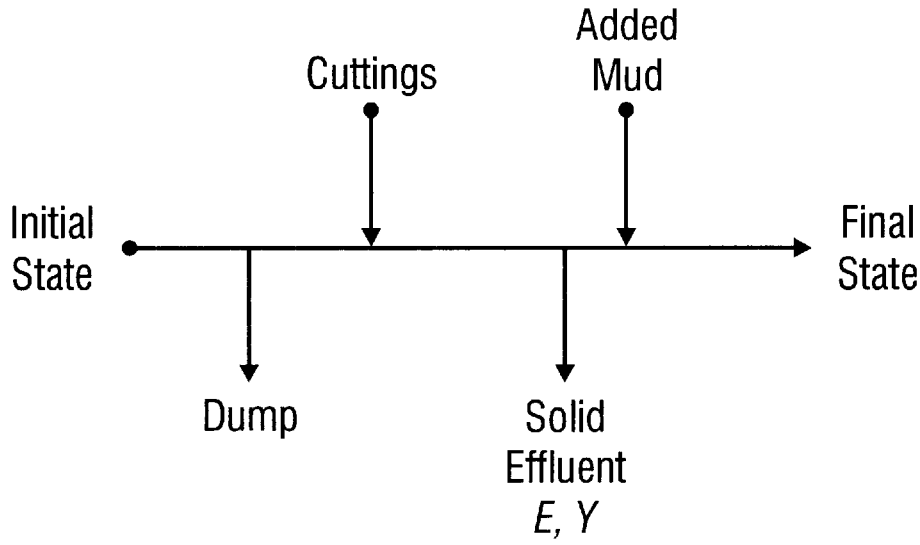
FIG. 1 is a diagram of a drilling mud circuit as modelled by the global approach.
Figure 2:
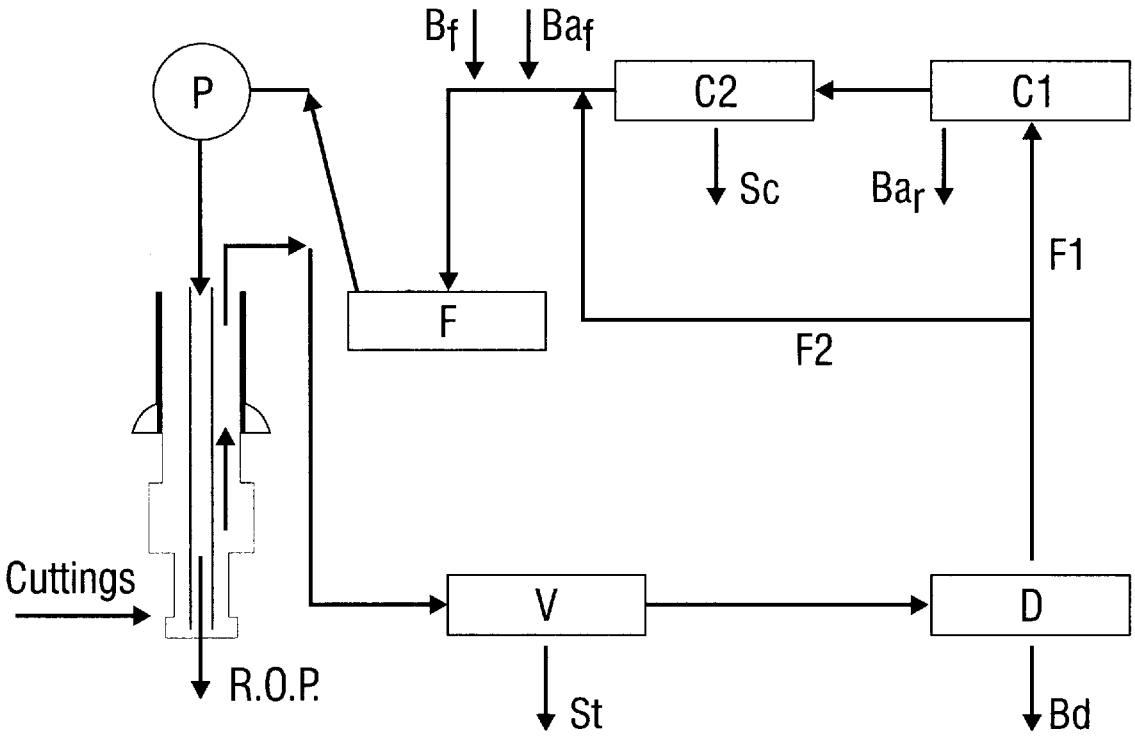
FIG. 2 is a diagram of a drilling mud circuit.

FIG. 1 is a diagram of a mud circuit as represented in the global approach. This representation is far removed from reality, which can be approached by using the circuit shown diagrammatically in FIG. 2 where account is taken of the fact that circulation is taking place round a loop. The plan shown in FIG. 2 is naturally only one particular example of a configuration and it is not especially representative of the way in which separation devices are arranged in practice.

The drilling mud circulation loop includes in particular a pit F from which the mud is pumped (P) for feeding the drilling tool which is penetrating into the formation at a known rate of penetration (ROP). The mud picks up the cuttings and rises via the annulus around the drill bit. In the example shown, it passes initially via a vibrator (V) which removes a portion of the flow St that is essentially constituted by the larger cuttings, the remainder being applied to a settling tank D from which a portion Bd of the mud is dumped. A fraction F1 of the main flow is applied to a set of centrifuges, while the complementary fraction F2 bypasses the set of centrifuges. In the configuration shown, two centrifuges C1 and C2 are connected in series, centrifuge C1 being used to recover the heavier solids, and in particular the barite $Ba_f$, and the centrifuge C2 is used to remove lighter solids, and in particular the finer cuttings that are not eliminated by the vibrator. The bypass makes it possible to match the quantity of mud that is applied to the centrifuges to their capacity. The density of the drilling mud is then adjusted by optionally adding barite $Ba_f$, and fresh mud $B_f$ is added, in particular to compensate for the increase in the volume of the system due to the progress of drilling. The clarified flow delivered by the various separation devices together with the added fresh mud is then poured in the pumping pit to loop the cycle.

The circuit is modelled by elementary logic units. These elementary units are preferably of the following types: adder, divider, mixer, pulverizer, and separator. The adder combines two flows, with the mass of the resulting flow being the sum of the input masses. The divider separates a flow into two flows having the same composition, and it is characterized by a volume ratio (identical to the mass ratio if it is assumed that there is no interaction between the various phases making up the mud). The mixer is perfect and instantaneously mixes a flow with a known volume of fluid present in a basin that is being emptied; it is characterized by an emptying flow rate. The pulverizer is characterized by an input flux and an output flux having the same mass and the same composition but a new distribution of particle sizes, which new distribution is derived from the distribution in the input flux by applying a transfer function. Finally, the separator separates out the solids contained in a flow and delivers a clarified downstream flow plus a filtrate constituted solely by solids of a size which is a function of the size of the solids in the input flow and a function of the separator partition.

In some cases these logic units correspond to real elements of the mud circuit (ignoring the volume of mud present in the various lengths of pipework, and the headlosses due to said pipework). Nevertheless, as a general rule, several elementary logic units are used in combination to model a separation device, as described below with reference to FIGS. 3 to 6.

The input and output flows are defined as mud objects and are referred to below more simply by the term "mud". Each mud is made up of p liquids (in most cases it can be assumed that p=1 even if the fluid is made from an emulsion of water-in-oil or oil-in-water), and of n solids. It is assumed below that there are three types of solid: a weighting material such as barite, a low density viscosity agent such as Bentonite, and the cuttings, themselves essentially constituted by clays and thus of a density that is very close to that of Bentonite. Each of the p+n liquid and solid components is characterized by its density and by its mass fraction in the drilling mud. The n solid components are further characterized by respective particle size distributions. Other parameters such as viscosity and rheology can also be incorporated in the model. In addition, a mass flow rate is associated with each mud object.

The mud objects are recalculated by each logic unit, the system being subordinated to controls that modify the parameters of the said logic units as a function of the targets set by the well borer. By way of example, these targets can be a limit concentration of clay (provided as an additive to the mud or coming from the drilled formations), a density for the mud available in the pumping pit ("light" solids) adapted to optimum operation of the drilling tool, or indeed a mud volume in the pumping pit that is constant or that remains between two specified levels (the volume of mud in the pumping pit can under no circumstances exceed the volume of the pit).

Each logic unit is characterized by input flows (in) and output flows (out) that obey various conservation laws: overall mass conservation for each solid S and each liquid L:

$$\sum_{\text{in}} M_{\text{in}}^{S,L} = \sum_{\text{out}} M_{\text{out}}^{S,L} \qquad \text{Equation 3.}$$

Overall conservation of volume:

$$\sum_{\text{in}} Q_{\text{in}}^{S,L} = \sum_{\text{out}} Q_{\text{out}}^{S,L} \qquad \text{Equation 4.}$$

And conservation of mass for each class i of particle size:

$$\sum_{\text{in}} Y_{i,\text{in}}^{S} M_{\text{in}}^{S} = \sum_{\text{out}} Y_{i,\text{out}}^{S} M_{\text{out}}^{S} \qquad \text{Equation 5.}$$

By definition, equation 5 is not valid for grinder type units.

For an upstream flow having a solids grain size distributing obeying a function F, a separator having a partition function G isolates a solid fraction of grain size distribution $F_r$ complying with the following function:

$$F_r = \frac{FG}{\int_0^{x_{\max}} FG\,dx} \qquad \text{Equation 6.}$$

where $X_{max}$ is the maximum size of the cuttings. The function $F_r$ is the normalized product FG, written $\overline{FG}$. In the clarified flow, the grain size distribution of the non-separated solids is thus equal to $\overline{F(1-G)}$. It should be observed that if two separators are connected in series, the grain size distribution in the clarified flow downstream from the two separators is independent of the order of the separators and is equal to $\overline{F(1-G1)(1-G2)}$.

For each solid species i, the mass recovered in the solid portion is a function of its grain size distribution $F_i$ and of its mass concentration $C_i$ in the input flow, and is given by the following equation:

$$D_i = \int_0^{x\max} F_i G\,dx \qquad \text{Equation 7.}$$

The mass concentration in the recovered solid portion is thus equal to:

$$C_{R,i} = \frac{C_i D_i}{\Sigma_{solids} C_i D_i} \qquad \text{Equation 8.}$$

and in the clarified flow:

$$C_{c,i} = \frac{1 - C_i D_i}{1 - \Sigma_{solids}(C_i D_i)} \qquad \text{Equation 9.}$$

When two muds 1 and 2 of masses $m_1$ and $m_2$ and of grain size distributions $F_1$ and $F_2$ are mixed, the grain size distribution $F_3$ of the mud that results from the mixture is equal to:

$$F_3 = \frac{m_1 C_1 F_1 + m_2 C_2 F_2}{m_1 C_1 + m_2 C_2} \qquad \text{Equation 10.}$$

The equations given above apply to the elementary units of the invention and in particular to the perfect separators which separate out solids only. In order to model real devices, it is necessary to use associations of elementary units.

Figure 3:
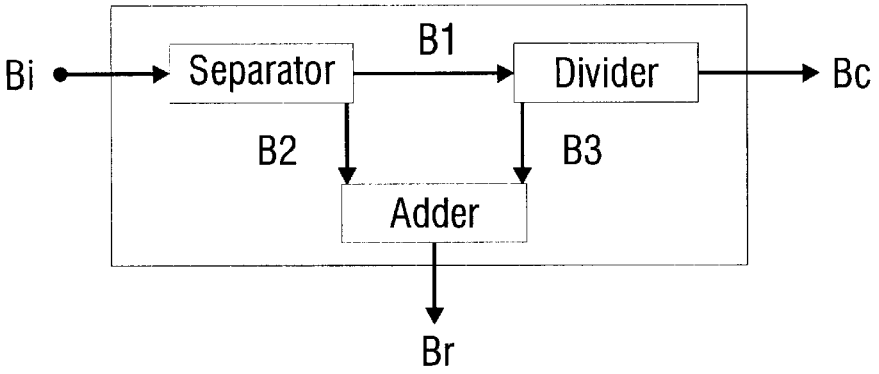
FIGS. 3 to 5B show how logic units having elementary actions are built up respectively for a vibrator (or a centrifuge), for a pumping pit, and for a well.

As shown in FIG. 3, a vibrator is thus modelled by means of a separator, a divider, and an adder. The divider reflects the fact that in practice the separated-out solids are wet with liquid such that the "solids" which do not pass through the screen constitute a "mud" having a certain liquid fraction. The vibrator is thus represented by a partition function G ($d_{50}$ and $\sigma$), and a number Y which is defined by the mass ratio of mud added by the divider (B3) to the mass of solids separated-out by the separator (B2).

The same applies to a centrifuge, except that with a centrifuge separation depends not only on particle size but also on particle density such that a partition function Gi must be defined for each solid species present in the mud.

The values for $d_{50}$ and s are given by the manufacturers of solid separator devices, with the terminology of the American Petroleum Institute (API) including vibrator-designating values $d_{50}$, $d_{16}$ and $d_{84}$ that indicate their separation potential. The solid/liquid ratio Y can be measured very simply.

By way of example, the partition function of a separator is modelled by a Degoul function of the type:

$$G(x) = \frac{x^m}{x^m + d_{50}^m} \qquad \text{Equation 11}$$

with $$m = \frac{\log\left(\frac{21}{4}\right)}{\log\left(I + \sqrt{1 + I^2}\right)} \qquad \text{Equation 12}$$

and $$I = \frac{d_{84} - d_{16}}{2d_{50}} \qquad \text{Equation 13}$$

but it is also possible to use other semi-empirical models proposed in the literature.

Vibrators and centrifuges are solid separation devices that operate under steady conditions, however that is not true of the pumping pit, the well, or the settling tank.

Hydrocyclone type equipment (settling tank and desilter) can also be modelled as a perfect separator plus a flow divider and an adder. For the partition function, it is possible, for example, to use the formula proposed by Rosin-Rammler:

$$G(x) = 1 - \exp\left(-0.693\left(\frac{x}{d_{50}}\right)^m\right) \quad \text{Equation 14}$$

where m is calculated using the formula proposed by L. R. Pitt in "*A mathematical model of the hydrocyclone classifier*", CIM Bulletin, Dec. 1976, or is estimated more simply by the simplified formula $m \approx 0.77/I$ where I is given by Equation 13.

Figure 4:
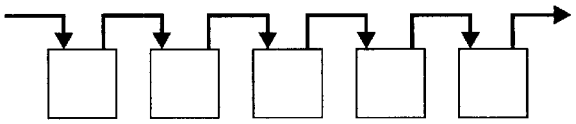
Figure 5A:
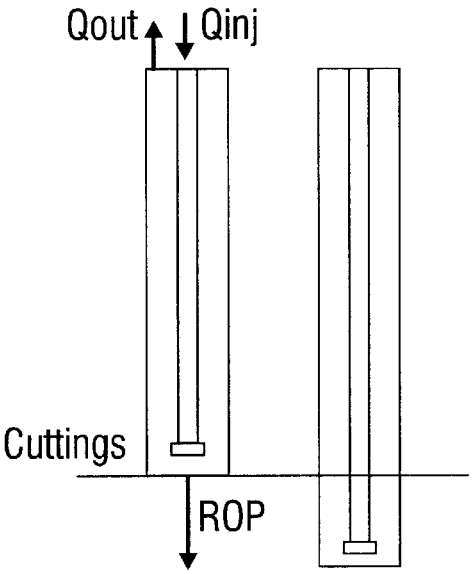
Figure 5B:
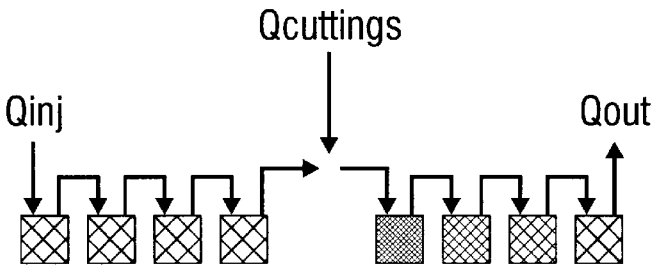
Figure 6:
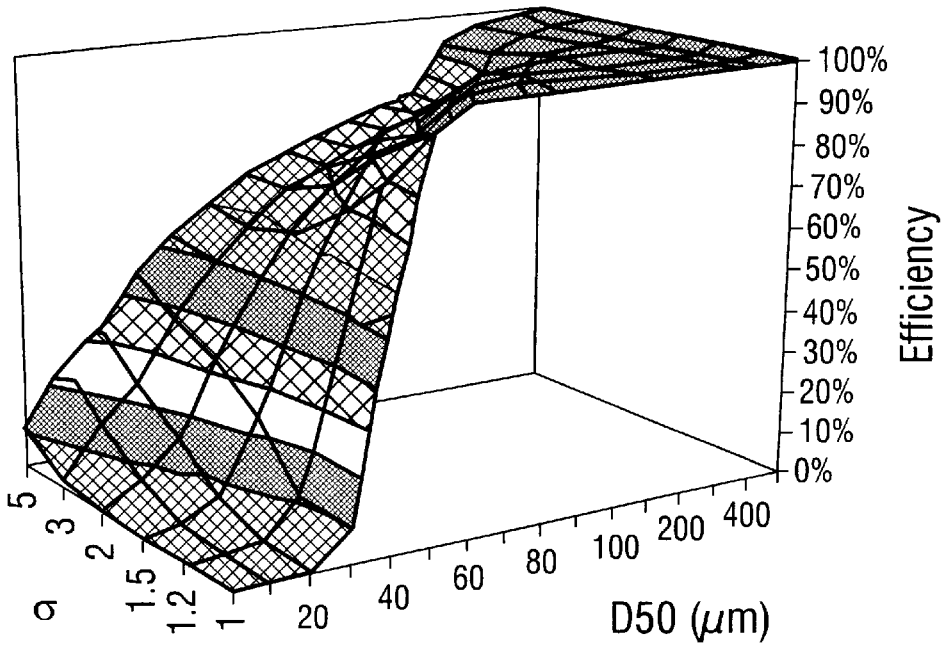
FIG. 6 is a curve representative of the efficiency of a vibrator as a function of the grain size distribution of the cuttings.

The pumping pit is preferably represented by a model of mixers in cascade, i.e. a set of N perfect mixers connected in series, as shown in FIG. 4. All of the mixers are of identical volume, the volume sum of all of the mixers being equal to the volume of mud in the pit, which volume can therefore decrease or increase but cannot exceed the physical volume of the pit. A mud state is calculated after each mixer by maintaining a constant flow rate for the flow into each mixer.

The concentration of solids is obtained by convolution of their concentration in the input flow by a transfer function of the following type:

$$E(t) = \left(\frac{N}{\tau}\right)^N \frac{t^{N-1}\exp\left(-\frac{Nt}{\tau}\right)}{(N-1)!} \quad \text{Equation 15}$$

where $\tau$ is the residence time in the pit, i.e. the ratio between the volume of the pit and the flow rate of the input flow. The grain size distributions are calculated from Equation 10. To model the well, as shown diagrammatically in FIGS. 5A and 5B, it is possible to subdivide it into a cutting-generator unit (at the drill bit), one or two mixer units (the annulus surrounding the drilling column, and possibly also the drilling column itself), and optionally a grinder.

For the two mixer units, it is possible to use a model comprising mixers in cascade as for the pit. Using the abbreviation ROP for the rate of penetration into the formation, $Q_{in}$ for the input flow rate into the drilling column (identical to the output flow rate from the pit), and $\Phi_p$ for the inside diameter of the drilling column, the (identical) residence time for each mixer is calculated and is equal to:

$$\tau = \frac{\pi\,\Phi_P^2 ROP}{4Q_{\text{in}}} t \quad \text{Equation 16}$$

and the flow rate of the output flow (feeding the drill pit) is equal to:

$$Q_{out} = Q_{in} - \pi/4\Phi^2{}_P \text{ROP}.$$

For the annulus of diameter $\Phi_A$, the procedure is the same, using the following expression to calculate the outlet flow rate:

$$Q_{out} = Q_{in} - \pi/4\text{ROP}\ ((1+W)\Phi^2{}_{bit} - \Phi^2{}_A) \quad \text{Equation 17}$$

In equation 17, $\Phi_{bit}$ is the diameter of the drill bit and W is hole washout, i.e. the amount the hole is enlarged relative to the nominal diameter of the drill bit (thus a "perfect" hole has W=0).

Cutting generation is modelled merely as an adder with cuttings (rock and fluids from the formation) at a mass flow rate q given by:

$$q = \pi/4\Phi^2{}_{bit}(1+W)\text{ROP}\rho_{cuttings} \quad \text{Equation 18}$$

In equation 18, W, $\Phi_{bit}$ and ROP have the same meanings as in equation 17, and $\rho_{cuttings}$ is equal to the density of the drilled formation (rock plus fluids in the formation).

Where necessary, other solid separation devices can be modelled in like manner by combining logic units.

For each time sequence, it is possible to modify some of the specific parameters of the circuit, for example varying the rate of penetration of the drill bit or a new type of formation being drilled (modifying the density of the cuttings).

The above description relates to only a few solid-separation devices, but naturally other devices could be modelled in analogous manner. It is also possible to make the models more complex, e.g. to take account of the existence of casing in the well or the various lengths of pipework in the mud circuit.

For each solid separation device, the invention makes it possible to calculate flow rates upstream and downstream therefrom and also the composition of the various flows. The model thus makes it easy to calculate at all times the efficiency of separation (defined as being the ratio of the volume of cuttings recovered over the volume of cuttings generated during the same time lapse).

Figure 7:
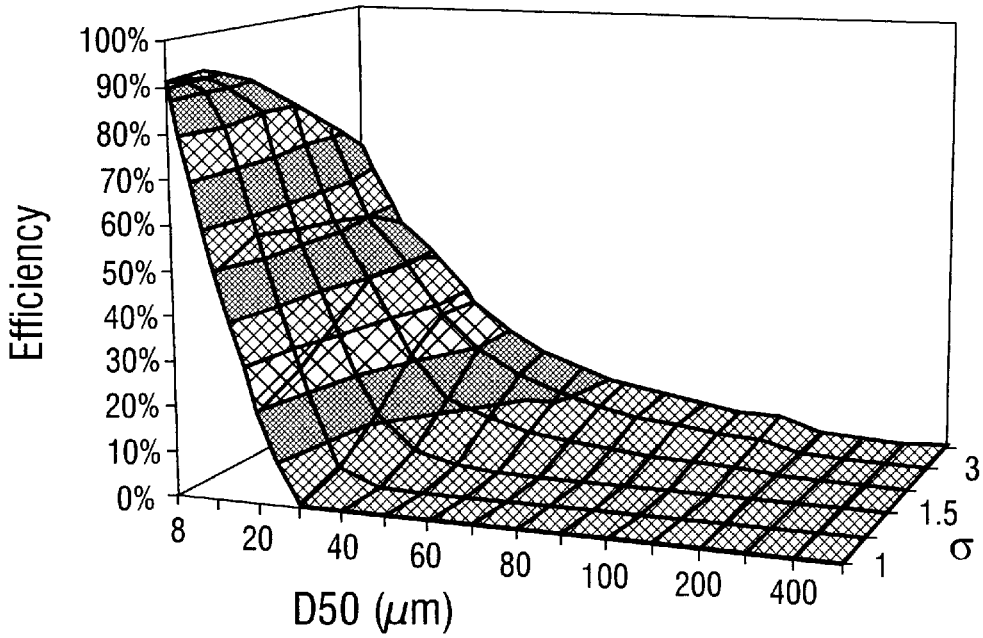
FIG. 7 is a curve representative of the efficiency of a centrifuge as a function of the grain size distribution of the cuttings.

For each separation device, it is thus possible to generate curves for predicting the efficiency of separation as a function of the grain size of the cuttings. An example of a curve representing the efficiency of a vibrator as a function of the grain size distribution of the cuttings ($D_{50}$ and standard deviation coefficient $\sigma$) is thus given in FIG. 6 while FIG. 7 shows the efficiency of a centrifuge as a function of the grain size distribution of the cuttings.

Figure 8:
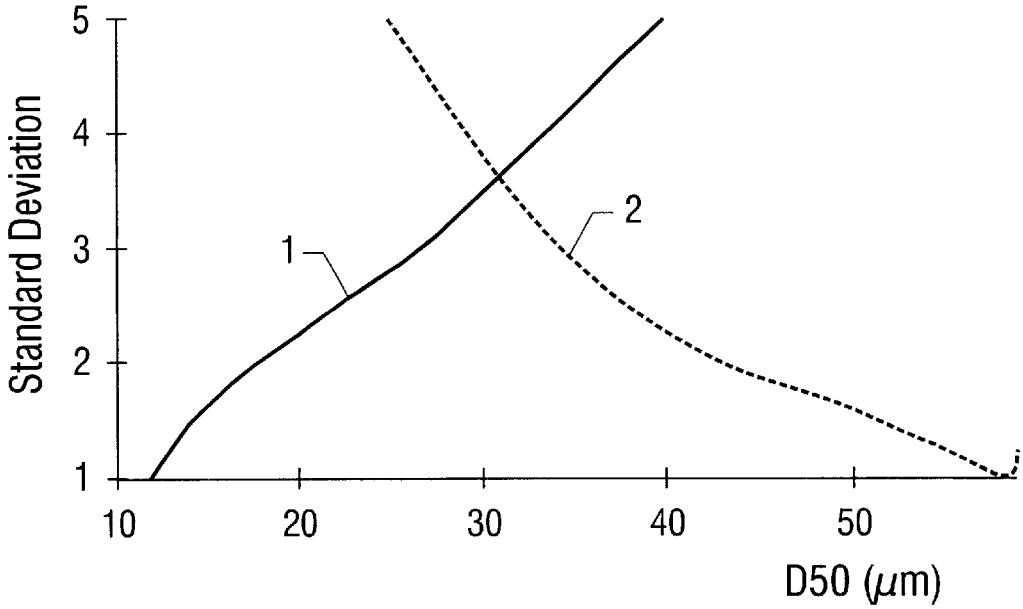
FIG. 8 is a graph showing how predictions are inverted to deduce the size of the cuttings on the basis of measurements of the efficiency of solid-separation devices.

Conversely, starting from such curves, and knowing the real efficiency of a given device in the solid control equipment, it is possible to calculate the initial distribution of the cuttings, as shown by way of example in FIG. 8. In FIG. 8, 1 designates a curve obtained by cutting the sheet of FIG. 6 on a plane corresponding to a measured efficiency for the vibrator of 20%. Similarly, 2 designates the curve obtained by cutting the sheet of FIG. 7 on a plane corresponding to a measured efficiency for the centrifuge of 58%. The point of intersection of curves 1 and 2 corresponds to the grain size of the cuttings.

Thus, starting from measurements that are very simple to perform on site, it is possible to estimate the grain size of the cuttings for the purpose of optimizing settings and simulations of subsequent drilling operations.

Having thus described the invention, what is claimed is:

1. A method of modelling the loop circuit travelled by a drilling mud during drilling, wherein the loop circuit includes the well and the surface equipment, and wherein each time sequence of the loop circuit is modelled by a network of logic units, and wherein each logic unit performs an elementary action including: dividing of flows, adding of flows; separating-out of solids; and, adding a flow to a volume that is being emptied, wherein the separating-out of solids is modeled by the application of a partition function G, wherein the partition function G is used to calculate the mass concentration of each liquid and solid species present in the mud, the total flow rate, and the grain size distribution of each solid species downstream from each item of equipment modeled by the logic units.

2. The method according to claim 1, characterized in that the parameters defining the logic units may be modified for each time sequence.

3. The method according to claim 1, characterized in that the grain size distribution is defined by a normalized frequency function F of the type $$M_{a,b} = \int_a^b F(x)\,dx$$

where $M_{a,b}$ is the mass percentage of particles of a diameter lying in the range a to b.

4. A method of modeling the loop circuit traveled by a drilling mud during drilling, including both the well and the surface equipment, in particular solid separation devices, in which for each time sequence, the loop circuit traveled by the mud is modeled by a network of logic units, each performing an elementary action: dividing or adding flows, separating-out solids, and adding a flow to a volume that is being emptied, with solids being separated-out in application of a partition function G in order to calculate the mass concentration of each liquid and solid species present in the mud, the total flow rate, and the grain size distribution of each solid species downstream from each item of equipment, and, wherein the parameters defining the logic units may be modified for each time sequence, and wherein the particle size distribution is defined by a normalized frequency function F of the type $$M_{a,b} = \int_a^b F(x)\,dx$$

where $M_{a,b}$ is the mass percentage of particles of diameter lying in the range a to b and wherein F is normal function described by a median particle size value ($d_{50}$) and a standard deviation coefficient σ, wherein $\sigma=d_{50}/d_{16}$.

5. A method of modeling the loop circuit traveled by a drilling mud during drilling, including both the well and the surface equipment, in particular solid separation devices, in which for each time sequence, the loop circuit traveled by the mud is modeled by a network of logic units, each performing an elementary action: dividing or adding flows, separating-out solids, and adding a flow to a volume that is being emptied, with solids being separated-out in application of a partition function G in order to calculate the mass concentration of each liquid and solid species present in the mud, the total flow rate, and the grain size distribution of each solid species downstream from each item of equipment, wherein the partition function is defined as the primitive of a normal distribution, $G_i(x)dx$ being defined as the mass percentage in the "solid" effluent of particles of species i of size lying in the range x to x+dx, and characterized by a median value $d_{50}$ and by a standard deviation coefficient.

6. A method of modeling the loop circuit traveled by a drilling mud during drilling, including both the well and the surface equipment, in particular solid separation devices, in which for each time sequence, the loop circuit traveled by the mud is modeled by a network of logic units, each performing an elementary action: dividing or adding flows, separating-out solids, and adding a flow to a volume that is being emptied, with solids being separated-out in application of a partition function G in order to calculate the mass concentration of each liquid and solid species present in the mud, the total flow rate, and the grain size distribution of each solid species downstream from each item of equipment, wherein the model includes predicting the efficiency coefficient of at least two solid control devices.

7. The method of claim 6 comprising the additional step of inverting said predictions, to estimate cutting size.

8. The method of claim 1 wherein said logic units are selected from the following: adder, divider, mixer, pulverizer, and separator.

9. The method of claim 1 wherein said logic units correspond to real elements of said circuit.

10. The method of claim 1 wherein at least one of said solid separation devices is a vibrator.

11. The method of claim 9 wherein said vibrator is simulated by means of a separator, a divider, and an adder.

12. The method of claim 1 wherein at least one of said solid separation devices is a hydrocyclone-type device.

13. The method of claim 11 wherein said hydrocyclone-type device is simulated by a perfect separator plus a flow divider and an adder.

14. The method of claim 1 wherein at least one of said solid separation devices is a pumping pit.

15. The method of claim 13 wherein said pumping pit is simulated by a plurality of perfect mixers in series.

16. A method of modeling the loop circuit traveled by a drilling mud during drilling, including both the well and the surface equipment, in particular solid separation devices, in which for each time sequence, the loop circuit traveled by the mud is modeled by a network of logic units, each performing an elementary action: dividing or adding flows, separating-out solids, and adding a flow to a volume that is being emptied, with solids being separated-out in application of a partition function G in order to calculate the mass concentration of each liquid and solid species present in the mud, the total flow rate, and the grain size distribution of each solid species downstream from each item of equipment, and wherein for each solid separation device, a curve is generated for predicting the efficiency of separation as a function of the grain size of the cuttings.

17. The method of claim 15 wherein an initial distribution of cuttings is determined from said curves and a value for the real efficiency of at least one solid separation device.

18. A method of modeling the loop circuit traveled by a drilling mud during drilling, including both the well and the surface equipment, in particular solid separation devices, in which for each time sequence, the loop circuit traveled by the mud is modeled by a network of logic units, each performing an elementary action: dividing or adding flows, separating-out solids, and adding a flow to a volume that is being emptied, with solids being separated-out in application of a partition function G in order to calculate the mass concentration of each liquid and solid species present in the mud, the total flow rate, and the grain size distribution of each solid species downstream from each item of equipment, wherein the method includes the step of determining cuttings generation, modeled as an adder, said cuttings having a mass flow rate given by:

$$q=\pi/4\Phi_{bit}^{2}(1+W)\mathrm{ROP}_{\rho cuttings}$$

19. The method of claim 1 comprising the additional step of modeling the existence of at least one length of pipe in a wellbore.

20. A method for estimating grain size distribution by performing the method as in claim 1.

* * * * *